US007051400B1

(12) United States Patent
Saldivar

(10) Patent No.: US 7,051,400 B1
(45) Date of Patent: May 30, 2006

(54) MULTI-PURPOSE CLEANING APPARATUS FOR USE WITH A DOUBLE BASIN SINK

(76) Inventor: Victor Eduardo Saldivar, 511 9th St., Worthington, MN (US) 56187

( * ) Notice: Subject to any disclaimer, the term of this patent is extended or adjusted under 35 U.S.C. 154(b) by 331 days.

(21) Appl. No.: 10/295,803

(22) Filed: Nov. 18, 2002

(51) Int. Cl.
*A47L 5/00* (2006.01)

(52) U.S. Cl. ..... 15/323; 15/327.2; 206/576

(58) Field of Classification Search ..... 15/321, 15/323, 314, 327.1, 327.2; 206/576
See application file for complete search history.

(56) References Cited

U.S. PATENT DOCUMENTS 2,731,103 A * 1/1956 Ortega ..... 15/323
3,200,432 A * 8/1965 Voegeli et al. ..... 15/323
3,296,648 A * 1/1967 Schaefer ..... 15/323
4,404,704 A 9/1983 Rabban
4,554,700 A * 11/1985 Lyman ..... 15/323
4,955,105 A * 9/1990 Sunagawa et al. ..... 15/323
5,263,223 A * 11/1993 Fiegel et al. ..... 15/323
6,155,413 A 12/2000 Bilanchone
2003/0208874 A1 * 11/2003 Steffen et al. ..... 15/323

* cited by examiner

*Primary Examiner*—Theresa T. Snider
(74) *Attorney, Agent, or Firm*—Richard L. Mikesell

(57) ABSTRACT

A cleaning apparatus for use with a double basin kitchen sink includes first and second shells pivotally attached to one another to form a portable housing. Each shell defines a plurality of recesses configured to hold cleaning attachments. A vacuum motor is operably mounted in one shell, and the other shell defines an internal soap mixing basin. The shells are configured to be placed over the sink when in an open position. This allows access to drain pipes and water faucets for either dry or wet cleaning. Transportation of the housing during cleaning is also eliminated.

2 Claims, 1 Drawing Sheet

10
12
14
16
18
20
22
24
26
28
30
32
34
36
38
40
42
44
46

MULTI-PURPOSE CLEANING APPARATUS FOR USE WITH A DOUBLE BASIN SINK

BACKGROUND OF THE INVENTION

The present invention generally relates to household and office cleaning implements. More particularly, the present invention resides in a cleaning apparatus for use with a double basin kitchen sink that is capable of wet or dry cleaning.

Implements and apparatus for cleaning an office or house are well-known. These include brooms, mops, sponges, squeegees, vacuums, floor cleaners, carpet shampooers, etc. Typically, an owner must have several of these implements at his or her disposal in order to effectively clean the house. For example, the owner must have a vacuum in order to remove dust and debris from carpets and rugs. A mop is necessary in order to clean tiles, linoleum, and other hard surfaces. A shampooer or the like is necessary in order to remove stains from upholstery, carpeting, etc.

Aside from the cost an inconvenience of owning and storing multiple implements, many of these implements are rather cumbersome in use. For example, a vacuum must be moved from one area of the house to another in order to vacuum all of the carpeting. Carpet shampooers often require attachment to a sink, or filling a basin with water in order to provide a water source. The basin full of water is rather heavy and cumbersome to move from one location to another.

Accordingly, there is a continuing need for a multi-purpose cleaning apparatus which enables an owner to vacuum ard shampoo carpeting, as well as clean hard surfaces such as tiled and linoleum floors. The present invention fulfills these needs and provides other related advantages.

SUMMARY OF THE INVENTION

The present invention resides in a house and office cleaning apparatus for use with a double basin kitchen sink. The apparatus generally comprises a first shell defining a plurality of recesses configured to hold cleaning attachments and the like. A vacuum motor is operably mounted within the first shell. An air inlet and outlet are formed in a wall of the first shell and in communication with the vacuum motor.

A second shell is pivotally attached to the first shell so that the shells are moveable between open and closed positions to create a portable housing. The second shell also defines a plurality of recesses configured to hold cleaning attachments and the like. The second shell also includes an internal soap mixing basin.

The first and second shells are configured to be placed over a kitchen sink when in the open position. A connecting pipe extends between the first and second shells, when in the open position, for facilitating the flow of pressure or fluid there between, such as when the apparatus is in use as a shampooer or foam cleaner.

In a particularly preferred embodiment, an air freshener exhaust port is formed in either the first or second shells for dispensing fragrant air during operation of the apparatus.

The first and second shells each include an outwardly extending flange. The flanges of the first and second shells cooperatively form a groove about the periphery of the closed housing to accept a vacuum hose therein.

A handle is connected to the housing for transport. The handle in a particularly preferred embodiment comprises clasp members extending from the first and second shells for maintaining the housing in a closed position.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figures 1, 2, 3:
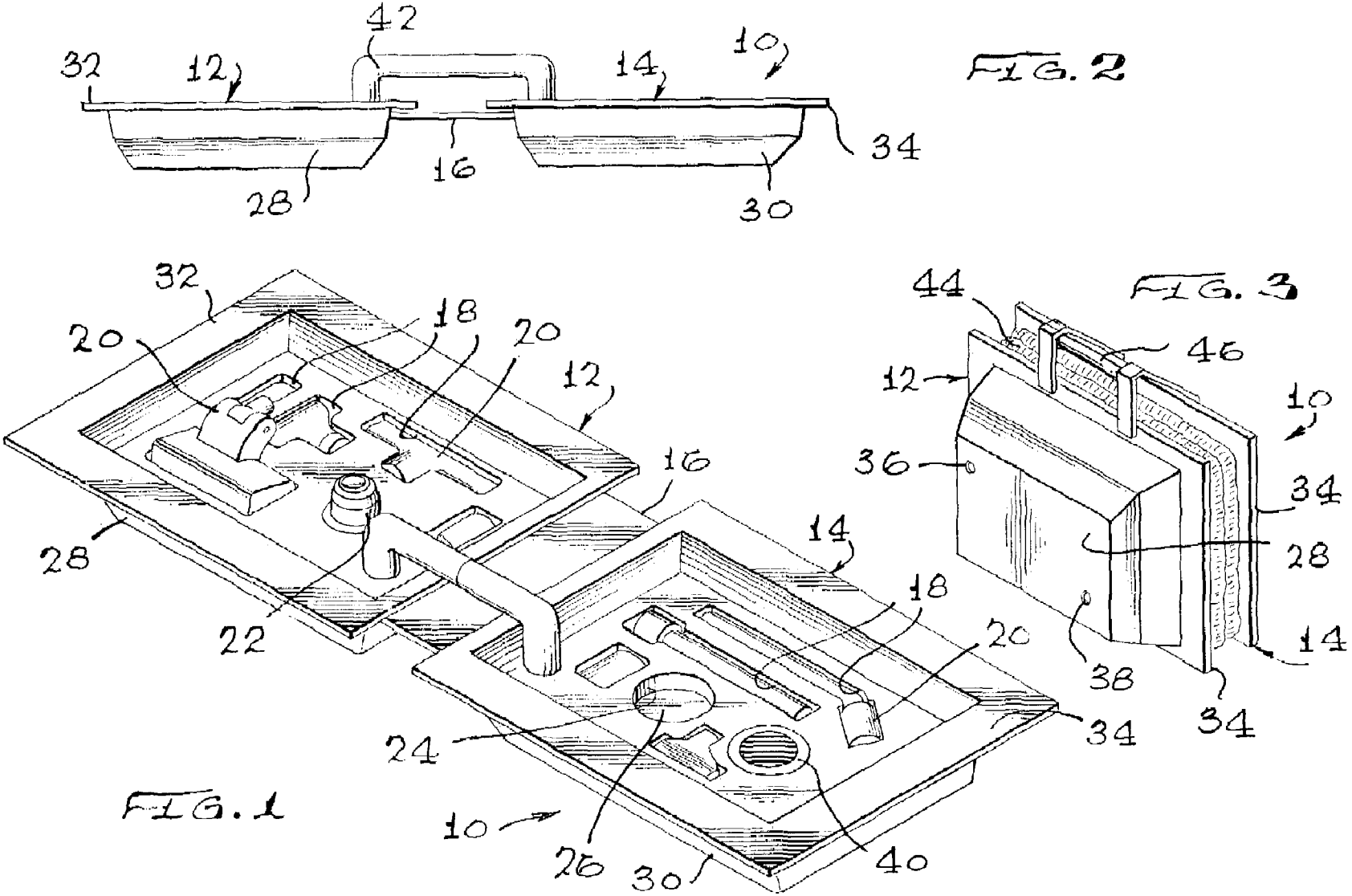
FIG. 1 is a perspective view of a multi-cleaning purpose apparatus embodying the present invention in an opened state.
FIG. 2 is a side elevational view of the open apparatus.
FIG. 3 is a prospective view of the apparatus in a closed state, and having a vacuum hose encircled thereabout.

As shown in the accompanying drawings for purposes of illustration, the present invention resides in a multi-purpose cleaning apparatus, generally referred to by the reference number 10. As shown in FIGS. 1 and 2, and as more fully described herein, the apparatus, when in an open state, is configured for use with a double basin kitchen sink.

With reference now to FIGS. 1 and 2, the apparatus 10 is comprised of first and second shells 12 and 14 pivotally connected to one another such as by the illustrated living hinge 16. The shells 12 and 14 can be opened, as shown in FIGS. 1 and 2, or closed, as shown in FIG. 3, to create a housing.

The first shell 12 includes a central area having a plurality of recesses 18 which are configured to removably receive cleaning attachments 20. As shown in FIG. 1, such attachments can comprise various vacuum head attachments, squeegees, carpet cleaning implements, etc. Preferably, each recess is specifically configured for a single accessory of the apparatus 10. A vacuum motor 22 is operably mounted within the shell 12. Typically, the vacuum motor 22 will include a lengthy electrical cord for plugging into an adjacent wall outlet.

The second shell 14 also includes a plurality of recesses 18 which are sized and configured such so as to hold attachments 20. Preferably, all of the attachments and solid hose lines and the like are held within specific recesses formed in the first and second shells 12 and 14. The second shell 14 also includes an aperture 24 providing access to an internal soap mixing basin or reservoir.

As shown in FIGS. 1 and 2 a bottom wall portion 28 and 30 of the first and second shells, 12 and 13, respectively, are sized and configured such so as to be inserted into a double basin sink, such as a standard kitchen sink. Thus, the kitchen sink faucet can be used to fill the basin 26 with hot water to create a desired soap solution therein. Placement of the apparatus 10 on a kitchen sink, as described, is also advantageous as there typically are electrical outlets adjacent to the sink. Thus, the vacuum motor 22 can be powered conveniently when dry vacuuming and the desired soap solution, such as a high suds, no residue cleaning solution with degreaser, can be created at the sink itself.

Each shell 12 and 14 includes a circumferential flange 32 and 34, respectively which extend outwardly from the shell 12 and 14. The flanges 32 and 34 may be comprised of a material which facilitates a vacuum seal between the apparatus 10 and the sink. Alternatively, the bottom walls 28 and 30 are sized such so as to form a frictional fit with the kitchen sink. In a particularly preferred embodiment, the bottom wall of the first shell 12 includes an air inlet 36 and an air outlet 38. Thus, air is drawn from the drain pipe of the sink, while dirt and debris from the soiled carpets are delivered into the sink for later disposal.

In a particularly preferred embodiment, a fragrance exhaust port 40 is formed in either the first or second shell, 12 or 14, thus, as the vacuum motor 22 is operated, air can be emitted through the fragrance port 40 containing a fragrance sponge, filter, etc., for emitting a desirable fragrance into the ambient air.

When in use as a carpet shampooer or foam generator, a connecting pipe 42 extends between the first and second shells 12 and 14 for directing pressurized air into the soap mixing basin 26. The pressure forces the soap mixture into the appropriate tube or outlet for cleaning. For example, a dual tube may be utilized wherein the hose includes a tube for dry vacuuming, and a co-extending tube which emits the soap mixture for shampooing and wet cleaning applications.

With reference to FIG. 3, when in the closed position the flanges 32 and 34 are spaced apart from one another to form a peripheral groove in the housing. The hose 44 may be wrapped around the housing in this groove for transportation and storage. The housing includes a handle 46 to facilitate transportation. The handle 46 may comprise clasp members extending from the first and second shells 12 and 14 for maintaining the housing in a closed position, while serving as the handle 46. Preferably, the apparatus 10 is comprised of a durable plastic and relatively light-weight, typically less than ten pounds, so as to be easily transported from storage to use.

The present invention provides many advantages over the prior art. The apparatus 10 effectively performs the functions of several traditional cleaning implements, such as a carpet shampooer, vacuum, upholstery cleaner, etc. The present invention also eliminates the need of moving a vacuum housing or the like from one cleaning location to another as the apparatus 10 resides in the kitchen sink throughout the cleaning operation.

Although several embodiments have been described in detail for purposes of illustration, various modifications may be made without departing from the scope and spirit of the invention. Accordingly, the invention is not to be limited, except as by the appended claims.

What is claimed is:

1. A house cleaning apparatus for use with a double basin kitchen sink, comprising:

a first shell defining a plurality of recesses configured to hold cleaning attachments, and having a vacuum motor operably mounted therein; and a second shell pivotally attached to the first shell, the first and second shells movable between an open position and a closed position to form a portable housing, the second shell defining a plurality of recesses configured to hold cleaning attachments, and an internal soap mixing basin;

wherein the first and second shells are configured to be placed over the sink when in the open position, including a connecting pipe extending between the first and second shells when in the open position for facilitating the flow of fluid therebetween.

2. A house cleaning apparatus for use with a double basin kitchen sink, comprising:

a first shell defining a plurality of recesses configured to hold cleaning attachments, and having a vacuum motor operably mounted therein, and an air inlet and an air outlet formed in a wall of the first shell and in communication with the vacuum motor;

a second shell pivotally attached to the first shell, the first and second shells movable between an open position and a closed position to form a portable housing, the second shell defining a plurality of recesses configured to hold cleaning attachments, and an internal soap mixing basin;

an air freshener exhaust port formed in either the first or second shells; and a handle connected to the housing;

wherein the first and second shells are configured to be placed in the sink when in the open position; and wherein the first and second shells each include an outwardly extending flange, the flanges of the first and second shells cooperatively forming a groove about the periphery of the housing configured to accept a vacuum hose therein including a connecting pipe extending between the first and second shells when in the open position for facilitating the flow of fluid therebetween.

* * * * *